US009345338B1

(12) United States Patent
Arch et al.

(10) Patent No.: US 9,345,338 B1
(45) Date of Patent: May 24, 2016

(54) PORTABLE FOLDING TABLE

(71) Applicant: Michael Thomas Arch, Boerne, TX (US)

(72) Inventors: Michael Thomas Arch, Boerne, TX (US); Bruce Charles McLellan, Round Rock, TX (US)

(73) Assignee: Michael Thomas Arch, Boerne, TX (US)

( * ) Notice: Subject to any disclaimer, the term of this patent is extended or adjusted under 35 U.S.C. 154(b) by 0 days.

(21) Appl. No.: 14/992,222

(22) Filed: Jan. 11, 2016

Related U.S. Application Data

(63) Continuation-in-part of application No. 14/631,741, filed on Feb. 25, 2015, now Pat. No. 9,232,862.

(51) Int. Cl.
*A47B 3/00* (2006.01)
*A47D 5/00* (2006.01)
*A47D 15/00* (2006.01)

(52) U.S. Cl.
CPC ..... *A47D 5/006* (2013.01); *A47D 15/00* (2013.01)

(58) Field of Classification Search
CPC ..... A47B 5/04; A47B 5/06; A47B 3/091; A47B 3/00; A47B 3/002; A47B 3/10; A47B 2003/0821; A47D 5/006; A47D 15/00
USPC ..... 108/38, 33, 34, 35, 36, 115, 129, 132, 108/162, 166, 167, 168, 171, 172, 173, 174, 108/169, 170, 138
See application file for complete search history.

(56) References Cited

U.S. PATENT DOCUMENTS 1,543,372 A * 6/1925 Andreas ..... A47B 3/083 108/35
2,057,334 A * 10/1936 Hannum ..... A47B 3/002 108/115
2,311,798 A * 2/1943 Weber ..... A47B 3/10 108/35
2,903,313 A * 9/1959 Block ..... A47B 3/083 108/167
3,110,476 A * 11/1963 Farris ..... B65G 69/24 108/119
3,379,472 A * 4/1968 Hilfiker ..... A47C 7/024 108/115
4,646,657 A * 3/1987 Zollinger ..... A47B 3/083 108/115
4,887,536 A * 12/1989 Teichner ..... A47B 3/10 108/35
4,926,758 A * 5/1990 Lilly et al. ..... A47B 23/001 108/115
5,078,056 A * 1/1992 McCauley ..... A47B 3/00 108/115
7,950,337 B2 * 5/2011 Chen ..... A47B 3/00 108/115
8,276,525 B2 * 10/2012 Janssen ..... A47B 21/02 108/115

(Continued)

*Primary Examiner* — Jose V Chen
(74) *Attorney, Agent, or Firm* — Shane V. Cortesi

(57) ABSTRACT

A portable, folding table that is particularly suited for changing a child's diaper is provided. The table includes a left panel, a middle panel, and a right panel and has an extended position in which the panels are substantially co-planar and a collapsed position in which the left and right panels fold between about 90 and about 180 degrees relative to the middle panel. The table optionally includes a handle attached to the front or rear side of the middle panel, legs attached to the left and right panels, and motors to move the panels between the extended and collapsed positions. Optionally, the left or right panel includes a bottom flange that serves as a leg and further serves to hide the other panels when the table is in the collapsed position.

19 Claims, 11 Drawing Sheets

(56) References Cited

U.S. PATENT DOCUMENTS

| | | | | |
|---|---|---|---|---|
| 8,418,282 | B2 * | 4/2013 | Luft-Weissberg | A47B 83/00 108/33 |
| 9,232,862 | B1 * | 1/2016 | Arch | A47D 5/006 |
| 2003/0196574 | A1 * | 10/2003 | Sagol | A47B 3/087 108/115 |
| 2005/0252422 | A1 * | 11/2005 | Sharpe et al. | A47B 3/00 108/35 |
| 2007/0251165 | A1 * | 11/2007 | Kern | A47C 17/52 52/173.1 |
| 2008/0202390 | A1 * | 8/2008 | Branch et al. | A47B 3/087 108/35 |
| 2008/0229497 | A1 * | 9/2008 | Paoutoff | A47C 17/42 5/136 |
| 2010/0275822 | A1 * | 11/2010 | Elford | A47B 3/00 108/115 |
| 2016/0051047 | A1 * | 2/2016 | Natuzzi | A47B 85/04 297/65 |

* cited by examiner

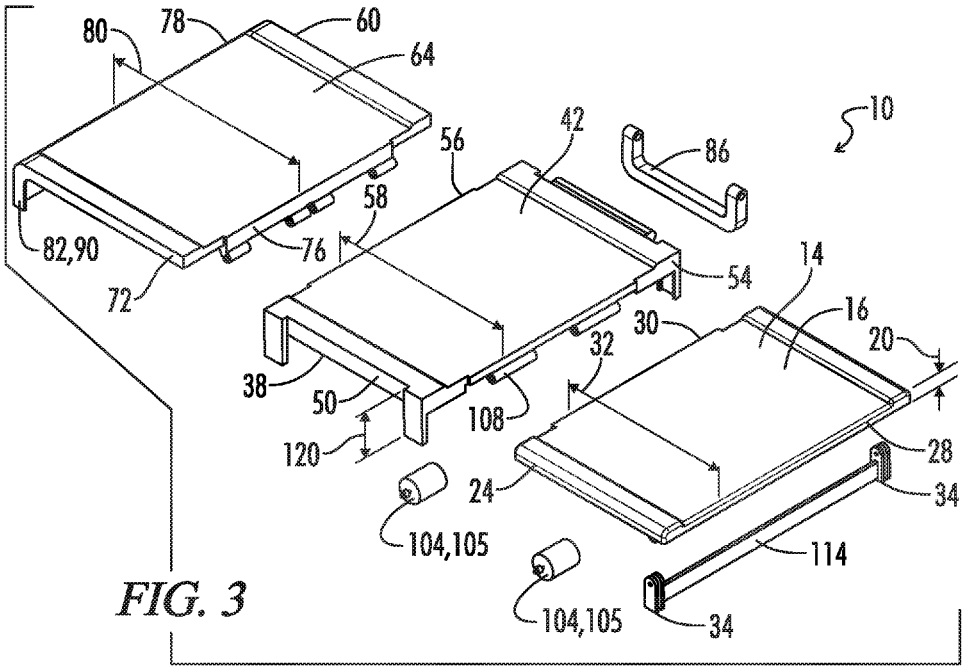
FIG. 3
FIG. 4
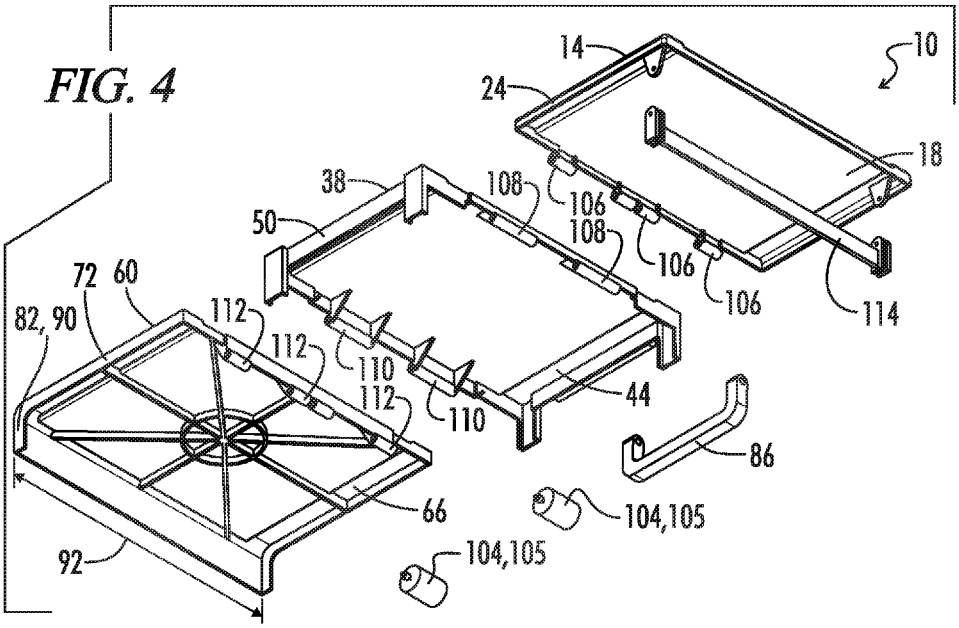

PORTABLE FOLDING TABLE

RELATED APPLICATIONS

This application is a continuation-in-part of U.S. patent application Ser. No. 14/631,741, entitled Portable Folding Table, filed Feb. 25, 2015, the entire contents of which are hereby incorporated by reference.

BACKGROUND

Technical Field

The present invention relates to portable folding tables, more specifically, portable folding tables that support infants and toddlers while an adult changes the infant or toddler's diaper.

BACKGROUND OF THE INVENTION

Diaper changing tables are known in the art. For example, Koala Care Products (Centennial, Colo.) sells diaper changing tables (otherwise referred to as baby changing stations) that are commonly found in restaurant and store restrooms in the United States. Commonly, the tables are mounted to a wall in the restroom and fold from the wall when in use. Unfortunately, however, not all restrooms have diaper changing tables and adults often need to change diapers when a restroom with a diaper changing table is not nearby. Moreover, even if a diaper changing table is available, many adults would prefer to carry their own sanitary changing table for sanitary reasons. Adults often need to change diapers at inconvenient times and locations.

U.S. Pat. No. 6,918,147 describes a foldable portable diaper changing pad that is made up of a left panel, a middle panel, and a right panel. The pad is designed to be placed over a sink or supported by two chairs. Unfortunately, however, it is not always possible to find a supporting structure when an adult needs to change a child's diaper. In addition, the pad of the '147 patent appears as it would require the adult to use both of his/her hands to set up, which is problematic when the adult is trying to hold a baby.

U.S. Design Pat. 367,771 describes a portable diaper changing table. However, it is believed that the diaper changing table described therein would be overly bulky and would require the adult to use both of his/her hands to set up.

Thus, there is a need for portable, diaper changing tables that are not bulky to carry, are strong enough to support children and can be used in a variety of environments where wall-mounted changing tables are not available.

BRIEF SUMMARY

The present disclosure provides a portable changing table that is not bulky to carry, is strong enough to support a child weighing at least 40 pounds and can be operated with only one hand. Often times an adult caregiver needs to hold a baby in one hand and, thus, only has one free hand with which to move and maneuver the table. Thus, optionally, the changing table is motorized and can be completely opened while holding it with one hand. The adult's other hand is free to hold onto the baby, thus making this a much safer option for an adult that wants to use a portable changing table.

In some embodiments, the portable changing table includes:

a left panel comprising a top surface, a bottom surface, a thickness extending from the top surface to the bottom surface, a front side, a rear side, a width extending from the front side to the rear side, a left side, a right side, a length extending from the left side to the right side, and at least one leg extending from the bottom surface;

a middle panel pivotably attached to the left panel along a left pivot axis, the left pivot axis generally perpendicular to the left panel length and generally parallel to the left panel width, the middle panel comprising a top surface, a bottom surface, a thickness extending from the top surface to the bottom surface, a front side, a rear side, a width extending from the front side to the rear side, a left side, a right side, and a length extending from the left side to the right side; and a right panel pivotably attached to the middle panel along a right pivot axis, the right pivot axis generally perpendicular to the middle panel length and generally parallel to the middle panel width, the right panel comprising a top surface, a bottom surface, a thickness extending from the top surface to the bottom surface, a front side, a rear side, a width extending from the front side to the rear side, a left side, a right side, a length extending from the left side to the right side, and at least one leg extending from the bottom surface, wherein the portable changing table has an extended position in which the middle panel extends along the right side of the left panel and along the left side of the right panel and the top surface of the left panel is substantially co-planar with the top surface of the middle panel and the top surface of the right panel, wherein the portable changing table has a collapsed position in which the right panel bottom surface confronts the left panel top surface and the left panel bottom surface confronts the middle panel bottom surface, and wherein at least one of the front of the middle panel and rear of the middle panel comprises a handle.

Optionally, the handle is configured to pivot from a storage position in which the handle is substantially co-planar with the middle panel thickness to an extended position in which the handle is substantially perpendicular to the middle panel thickness. Optionally, the handle is configured to pivot along a handle pivot axis from the storage position to the extended position, the handle pivot axis generally parallel to the middle panel length. Optionally, the middle panel further comprises a handle recess configured to store the handle when the handle is in the storage position. Optionally, the portable changing table is configured to move from the extended position to the collapsed position by folding the right panel between about 90 degrees and about 180 degrees relative to the middle panel along the right pivot axis and folding the left panel between about 90 degrees and about 180 degrees relative to the middle panel along the left pivot axis. Optionally, the handle is located at the front of the middle panel, and the right panel further comprises a bottom flange forming the leg of the right panel, and the bottom flange has a bottom flange width generally parallel to the right panel width and a bottom flange height generally perpendicular to the right panel width, and the bottom flange height is at least as large as the combined thickness of the middle panel and the left panel (i.e., the bottom flange height is equal to or greater than the sum of the middle panel and the left panel thicknesses). Optionally, in the extended position, the middle panel extends substantially the entire width of the left panel and substantially the entire width of the right panel. Optionally, in the extended position, the table further comprises a left front gap located between the front of the right side of the left panel and the front of the left side of the middle panel, a left rear gap located between the rear of the right side of the left panel and the rear of the left side of the middle panel, a right front gap located between the front of the left side of the right panel and the front of the right side of the middle panel, and a right rear gap located between the rear of the left side of the right panel and the rear of the right side of the middle panel. Optionally, the portable changing table further comprises at least one motor configured to fold the left panel relative to the middle panel along the left pivot axis and to fold the right panel relative to the middle panel along the right pivot axis and at least one power source configured to power the at least one motor. Optionally, moving the handle is configured to control the motor. Optionally, the left panel right side comprises a left panel flange extending towards the middle panel, wherein the middle panel left side comprises a middle panel left flange extending towards the left panel, wherein the left panel flange is attached to the middle panel left flange along the left pivot axis to create a left hinge, wherein the right panel left side comprises a right panel flange extending towards the middle panel, wherein the middle panel right side comprises a middle panel right flange extending towards the right panel, and further wherein the right panel flange is attached to the middle panel right flange along the right pivot axis to create a right hinge. Optionally, the length of the left panel is substantially equal to the length of the middle panel and the length of the right panel. Optionally, the legs each have a height generally parallel to the thicknesses of the left, middle and right panels, and further wherein the height of each leg is from about 3 inches to about 3 feet. Optionally, the portable changing table has a length extending from the left panel left side to the right panel right side, and further wherein the length of the portable changing table is from about 3 feet to about 8 feet. Optionally, the top surface of the left panel right side confronts the top surface of the middle panel left side in the extended position, wherein the confrontation of the top surface of the left panel right side and the top surface of the middle panel left side in the extended position is configured to prevent the portable changing table from moving from the extended position to an over-extended position in which the top surface of the left panel moves towards the top surface of the middle panel, wherein the top surface of the right panel left side confronts the top surface of the middle panel right side in the extended position, and wherein the confrontation of the top surface of the right panel left side and the top surface of the middle panel right side in the extended position is configured to prevent the portable changing table from moving from the extended position to an over-extended position in which the top surface of the right panel moves towards the top surface of the middle panel. Optionally, at least one of the legs is configured to pivot from a storage position in which the leg is substantially co-planar relative to the bottom surface of the panel to which the leg is attached to an extended position in which the leg is substantially perpendicular relative to the bottom surface of the panel to which the leg is attached. Optionally, the left, middle and right panels are generally rectangular in shape.

Optionally, the portable changing table is used in a method that includes:

a) providing the portable changing table wherein the portable changing table is in the extended position; and b) placing a child on the top surfaces of at least one of the left panel, the middle panel and the right panel.

Optionally, the portable changing table is used in a method that includes:

a) providing the portable changing table wherein the portable changing table is in the extended position, wherein the handle is located at the front of the middle panel, wherein the right panel further comprises a bottom flange forming the leg of the right panel, wherein the bottom flange has a bottom flange width generally parallel to the left panel width and a bottom flange height generally perpendicular to the bottom flange width, and further wherein the bottom flange height is approximately equal to the combined thickness of the middle panel and the left panel;

b) folding the left panel between about 90 degrees and about 180 degrees relative to the middle panel along the left pivot axis; and c) after step b, folding the right panel between about 90 degrees and about 180 degrees relative to the middle panel along the right pivot axis.

In still further embodiments, the present disclosure provides a portable changing table that includes:

a left panel comprising a top surface, a bottom surface, a thickness extending from the top surface to the bottom surface, a front side, a rear side, a width extending from the front side to the rear side, a left side, a right side, a length extending from the left side to the right side, and at least one leg extending from the bottom surface;

a middle panel pivotably attached to the left panel along a left pivot axis, the left pivot axis generally perpendicular to the left panel length and generally parallel to the left panel width, the middle panel comprising a bottom surface, a top surface, a thickness extending from the top surface to the bottom surface, a front side, a rear side, a width extending from the front side to the rear side, a left side, a right side, and a length extending from the left side to the right side; and a right panel pivotably attached to the middle panel along a right pivot axis, the right pivot axis generally perpendicular to the middle panel length and generally parallel to the middle panel width, the right panel comprising a top surface, a bottom surface, a thickness extending from the top surface to the bottom surface, a front side, a rear side, a width extending from the front side to the rear side, a left side, a right side, a length extending from the left side to the right side, and at least one leg extending from the bottom surface, wherein the portable changing table has an extended position in which the middle panel extends along the right side of the left panel and along the left side of the right panel and the top surface of the left panel is substantially co-planar with the top surface of the middle panel and the top surface of the right panel, wherein the portable changing table has a collapsed position in which the right panel bottom surface confronts the left panel top surface and the left panel bottom surface confronts the middle panel bottom surface, and further wherein one of the right and the left panel further comprises a bottom flange forming the leg of the panel, wherein the bottom flange has a bottom flange width generally parallel to the panel's width and a bottom flange height generally perpendicular to the panel's width, and further wherein the bottom flange height is at least as large as the combined thickness of the other panels.

Optionally, the above embodiment includes a handle, a handle recess, at least one motor, gaps, panel flanges and hinges as previously described, and the panels are dimensioned and foldable as previously described.

In still further embodiments, the portable changing table includes:

a left panel comprising a top surface, a bottom surface, a thickness extending from the top surface to the bottom surface, a front side, a rear side, a width extending from the front side to the rear side, a left side, a right side, a length extending from the left side to the right side, and at least one leg extending from the bottom surface;

a middle panel pivotably attached to the left panel along a left pivot axis, the left pivot axis generally perpendicular to the left panel length and generally parallel to the left panel width, the middle panel comprising a top surface, a bottom surface, a thickness extending from the top surface to the bottom surface, a front side, a rear side, a width extending from the front side to the rear side, a left side, a right side, and a length extending from the left side to the right side; and a right panel pivotably attached to the middle panel along a right pivot axis, the right pivot axis generally perpendicular to the middle panel length and generally parallel to the middle panel width, the right panel comprising a top surface, a bottom surface, a thickness extending from the top surface to the bottom surface, a front side, a rear side, a width extending from the front side to the rear side, a left side, a right side, a length extending from the left side to the right side, and at least one leg extending from the bottom surface, wherein the portable changing table has an extended position in which the middle panel extends along the right side of the left panel and along the left side of the right panel and the top surface of the left panel is substantially co-planar with the top surface of the middle panel and the top surface of the right panel, wherein the portable changing table has a collapsed position in which the right panel bottom surface confronts the left panel top surface and the left panel bottom surface confronts the middle panel bottom surface, and further wherein the table further comprises at least one motor configured to fold the left panel relative to the middle panel along the left pivot axis and to fold the right panel relative to the middle panel along the right pivot axis and at least one power source configured to power the at least one motor.

Optionally, the above embodiment includes a handle, a handle recess, a bottom flange, panel flanges, gaps, and hinges as previously described, and the panels are dimensioned and foldable as previously described.

In still further embodiments, the portable changing table includes:

a left panel comprising a top surface, a bottom surface, a thickness extending from the top surface to the bottom surface, a front side, a rear side, a width extending from the front side to the rear side, a left side, a right side, a length extending from the left side to the right side, and at least one leg extending from the bottom surface;

a middle panel pivotably attached to the left panel along a left pivot axis, the left pivot axis generally perpendicular to the left panel length and generally parallel to the left panel width, the middle panel comprising a top surface, a bottom surface, a thickness extending from the top surface to the bottom surface, a front side, a rear side, a width extending from the front side to the rear side, a left side, a right side, and a length extending from the left side to the right side;

a right panel pivotably attached to the middle panel along a right pivot axis, the right pivot axis generally perpendicular to the middle panel length and generally parallel to the middle panel width, the right panel comprising a top surface, a bottom surface, a thickness extending from the top surface to the bottom surface, a front side, a rear side, a width extending from the front side to the rear side, a left side, a right side, a length extending from the left side to the right side, and at least one leg extending from the bottom surface, a left motor comprising a left motor base located below the middle panel top surface and attached to the left side of the middle panel and a rotatable left motor shaft extending from the left motor base, the left motor shaft comprising a proximal segment, a distal segment attached to the right side of the left panel and a left motor shaft longitudinal axis generally parallel to the middle panel width and forming a part of the left pivot axis, the left motor shaft configured to rotate about the left motor shaft longitudinal axis while the left motor base remains fixed to the middle panel, a right motor comprising a right motor base located below the middle panel top surface and attached to the right side of the middle panel and a rotatable right motor shaft extending from the right motor base, the right motor shaft comprising a proximal segment, a distal segment attached to the left side of the right panel and a right motor shaft longitudinal axis generally parallel to the middle panel width and forming a part of the right pivot axis, the right motor shaft configured to rotate about the right motor shaft longitudinal axis while the right motor base remains fixed to the middle panel, wherein the portable changing table has an extended position in which the middle panel extends along the right side of the left panel and along the left side of the right panel and the top surface of the left panel is substantially co-planar with the top surface of the middle panel and the top surface of the right panel, wherein the portable changing table has a collapsed position in which the right panel bottom surface confronts the left panel top surface and the left panel bottom surface confronts the middle panel bottom surface, and further wherein rotation of the left motor shaft about the left motor shaft longitudinal axis while the left motor base remains fixed to the middle panel and rotation of the right motor shaft about the right motor shaft longitudinal axis while the right motor base remains fixed to the middle panel causes the left and right panels to move relative to the middle panel and the portable changing table to move from the extended position to the collapsed position.

Optionally, at least one of the front of the middle panel and the rear of the middle panel comprises a rigid plastic handle. Optionally, the handle is configured to pivot from a storage position in which the handle is substantially co-planar with the middle panel thickness to an extended position in which the handle is substantially perpendicular to the middle panel thickness. Optionally, the handle is located at the front of the middle panel, wherein the right panel further comprises a bottom flange forming the at least one leg of the right panel, wherein the bottom flange has a bottom flange width generally parallel to the right panel width and a bottom flange height generally perpendicular to the right panel width, and further wherein the bottom flange height is at least as large as the combined thickness of the middle panel and the left panel. Optionally, the portable changing table further comprises a controller comprising a rocker switch controlling movement of the left motor shaft about the left motor shaft longitudinal axis and movement of the right motor shaft about the about the right motor shaft longitudinal axis. Optionally, depressing the rocker switch on a first side causes the left motor and the right motor to move the left and right panels from the collapsed position to the extended position, and depressing the rocker switch on a side opposite to the first side causes the left motor and the right motor to move the left and right panels from the extended position to the collapsed position. Optionally, the portable changing table is configured to move from the extended position to the collapsed position by using the right motor to fold the right panel between about 90 degrees and about 180 degrees relative to the middle panel along the right pivot axis and by using the left motor to fold the left panel between about 90 degrees and about 180 degrees relative to the middle panel along the left pivot axis. Optionally, the left motor shaft distal segment is a non-circular shape and is located in a non-circular recess in the middle panel left side and further wherein the right motor shaft distal segment is a non-circular shape and is located in a non-circular recess in the middle panel right side. Optionally, the at least one leg attached to the left panel is moveable and further wherein the portable changing table further comprises an electric leg motor comprising a leg motor base attached to the left panel and a rotatable leg motor shaft extending from the leg motor base, the leg motor shaft comprising a proximal segment, a distal segment attached to the at least one leg and a leg motor shaft longitudinal axis generally parallel to the width of the left panel, the leg motor shaft configured to rotate about the leg motor shaft longitudinal axis while the leg motor base remains fixed to the left panel and further wherein rotation of the leg motor shaft about the leg motor shaft longitudinal axis while the leg motor base remains fixed to the left panel is configured to move the at least one leg from a storage position in which the at least one leg is substantially co-planar with the bottom surface of the left panel to an extended position in which the moveable leg is between about 30 and 150 degrees relative to the bottom surface of the left panel. Optionally, the left panel right side comprises a left panel flange extending towards the middle panel, wherein the middle panel left side comprises a middle panel left flange extending towards the left panel, wherein the left motor base is attached to the middle panel left flange, wherein the left motor shaft distal segment is attached to the left panel flange, wherein the right panel left side comprises a right panel flange extending towards the middle panel, wherein the middle panel right side comprises a middle panel right flange extending towards the right panel, wherein the right motor base is attached to the middle panel right flange, and further wherein the right motor shaft distal segment is attached to the right panel flange. Optionally, the length of the left panel is substantially equal to the length of the middle panel and the length of the right panel. Optionally, the legs each have a height generally parallel to the thicknesses of the left, middle and right panels, and further wherein the height of each leg is from about 3 inches to about 3 feet. Optionally, the portable changing table has a length extending from the left panel left side to the right panel right side, and further wherein the length of the portable changing table is from about 3 feet to about 8 feet. Optionally, the top surface of the left panel right side confronts the top surface of the middle panel left side in the extended position, wherein the confrontation of the top surface of the left panel right side and the top surface of the middle panel left side in the extended position is configured to prevent the portable changing table from moving from the extended position to an over-extended position in which the top surface of the left panel moves towards the top surface of the middle panel, wherein the top surface of the right panel left side confronts the top surface of the middle panel right side in the extended position, and wherein the confrontation of the top surface of the right panel left side and the top surface of the middle panel right side in the extended position is configured to prevent the portable changing table from moving from the extended position to an over-extended position in which the top surface of the right panel moves towards the top surface of the middle panel. Optionally, the left motor base comprises a bottom surface and a top surface comprising left motor teeth, wherein the middle panel left side comprises middle panel left side teeth engaging the left motor teeth, wherein the right motor base comprises a bottom surface and a top surface comprising right motor teeth, and further wherein the middle panel right side comprises middle panel right side teeth engaging the right motor teeth.

Optionally, the portable changing table is used in a method that includes:

a) providing the portable changing table wherein the portable changing table is in the extended position; and b) placing a child on the top surfaces of at least one of the left panel, the middle panel and the right panel.

Optionally, the portable changing table is used in a method that includes:

a) providing the portable changing table wherein the portable changing table is in the extended position, wherein the front of the middle panel comprises a handle and the rear of the middle panel is resting on a surface; and b) using the left motor to fold the left panel between about 90 degrees and about 180 degrees relative to the middle panel along the left pivot axis and using the right motor to fold the right panel between about 90 degrees and about 180 degrees relative to the middle panel along the right pivot axis.

In still further embodiments, the present disclosure provides a portable changing table that includes:

a first panel comprising a top surface, a bottom surface, a thickness extending from the top surface to the bottom surface, a front side, a rear side, a width extending from the front side to the rear side, a left side, a right side, a length extending from the left side to the right side, and at least one leg extending from the bottom surface;

a second panel pivotably attached to the first panel along a first pivot axis, the first pivot axis generally perpendicular to the first panel length and generally parallel to the first panel width, the second panel comprising a top surface, a bottom surface, a thickness extending from the top surface to the bottom surface, a front side, a rear side, a width extending from the front side to the rear side, a left side, a right side, and a length extending from the left side to the right side;

a motor comprising a motor base located below the top surface of the first panel and attached to a side of the first panel adjacent to the second panel and a rotatable motor shaft extending from the motor base, the motor shaft comprising a proximal segment, a distal segment attached to a side of the second panel and a left motor shaft longitudinal axis generally parallel to the second panel width and forming a part of the first pivot axis, the motor shaft configured to rotate about the motor shaft longitudinal axis while the motor base remains fixed to the first panel, wherein the portable changing table has an extended position in which the left side of the second panel extends along the right side of the first panel and the top surface of the first panel is substantially co-planar with the top surface of the second panel, wherein the portable changing table has a collapsed position in which the second panel does not extend along the right side of the first panel and in which the top surface of the first panel is not substantially co-planar with the top surface of the second panel, and further wherein rotation of the motor shaft between about 90 and about 180 degrees about the motor shaft longitudinal axis while the left motor base remains fixed to the first panel causes the second panel to move relative to the first panel and the portable changing table to move from the extended position to the collapsed position.

In some embodiments, the portable changing table is used in a method that includes:

a) providing the portable changing table wherein the portable changing table is in the extended position, wherein the front of the one first and second panels comprises a rigid handle and the rear of the first and second panels are resting on a surface; and b) folding the first panel between about 90 degrees and about 180 degrees relative to the second panel along the pivot axis.

BRIEF DESCRIPTION OF THE DRAWINGS

in FIG. 1, the portable folding table is in the extended position.

FIG. 3 illustrates a rear, exploded perspective view of the portable folding table of FIG. 1.

FIG. 4 illustrates a bottom, exploded perspective view of the portable folding table of FIG. 1.

in FIG. 8, the portable changing table is partially folded.

in FIG. 9, the portable changing table is almost completely folded.

in FIG. 10, the portable changing table is in the collapsed position and the handle is in the extended position.

in FIG. 11, the portable changing table is in the collapsed position and the handle is in the storage position.

in FIG. 13, the portable folding table is in the extended position.

in FIG. 17, the longitudinal axis of the right motor shaft is longer than the length of the right motor shaft only for illustration purposes—i.e., to label the axis.

in FIG. 18, the longitudinal axis of the left motor shaft is longer than the length of the left motor shaft only for illustration purposes—i.e., to label the axis.

in FIG. 19, the longitudinal axis of the leg motor is longer than the length of the leg motor shaft only for illustration purposes—i.e., to label the axis.

in FIG. 20, the portable changing table is partially folded.

in FIG. 20, the portable changing table is in the collapsed position.

DETAILED DESCRIPTION

Figure 1:
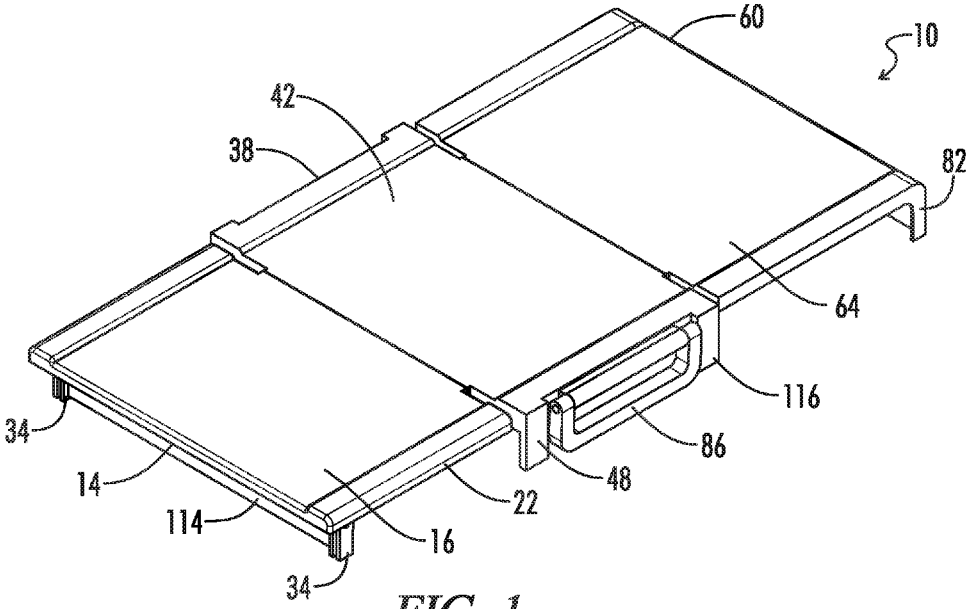
FIG. 1 illustrates a front, perspective view of a portable folding table of one embodiment of the present invention.
Figure 2:
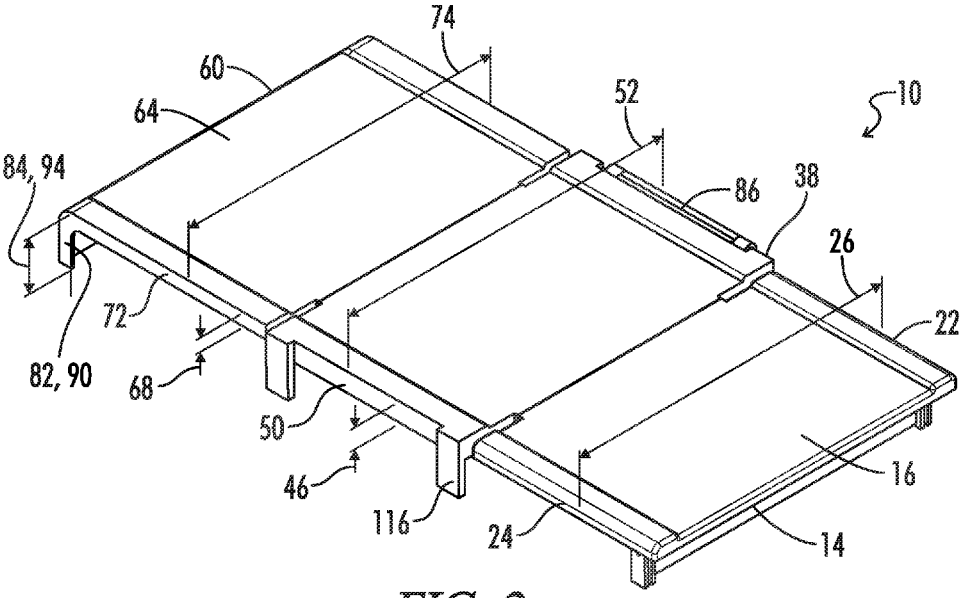
FIG. 2 illustrates a rear, perspective view of the portable folding table of FIG. 1.
Figure 5:
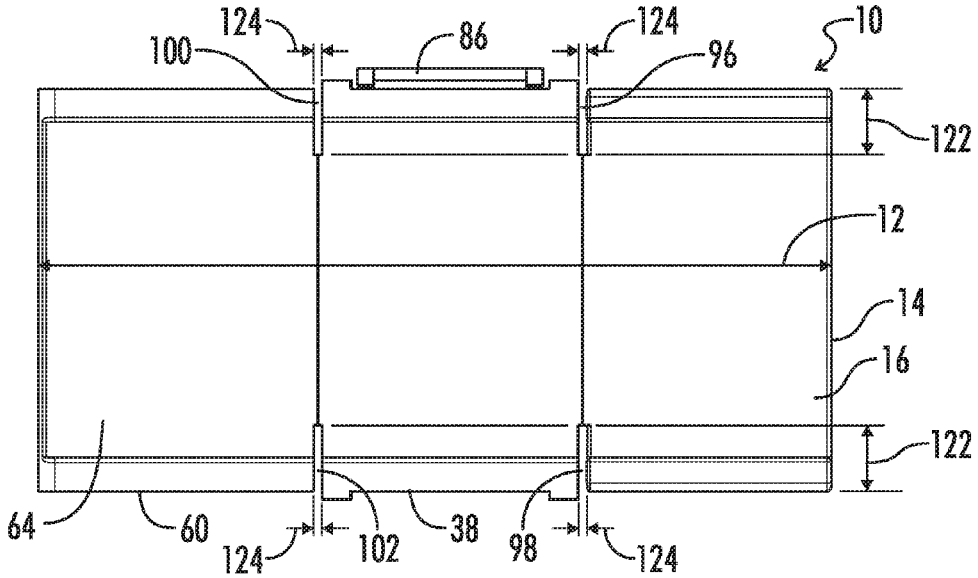
FIG. 5 illustrates a top, plan view of the portable folding table of FIG. 1.
Figure 6:
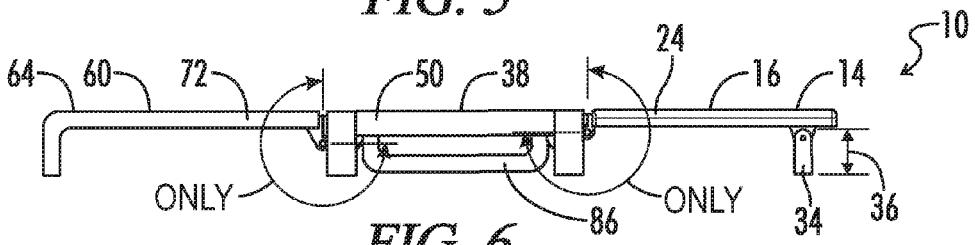
FIG. 6 illustrates a rear, elevation view of the portable folding table of FIG. 1.
Figure 7:
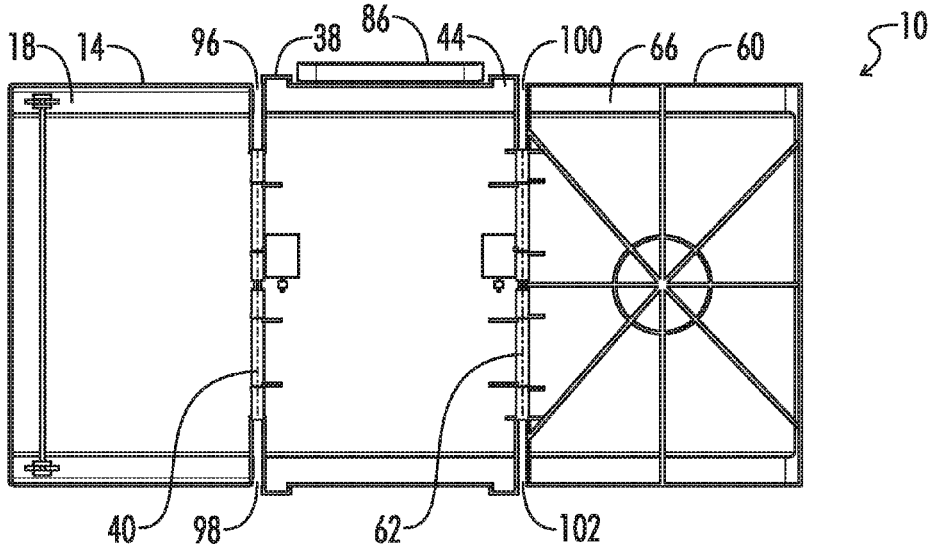
FIG. 7 illustrates a bottom, plan view of the portable folding table of FIG. 1.

With reference to FIGS. 1-12 the present disclosure provides a portable, folding table generally designated by the numeral 10. In the drawings, not all reference numbers are included in each drawing for the sake of clarity.

Referring to FIGS. 1-12, the present disclosure provides a portable changing table 10 comprising:

a left panel 14 comprising a top surface 16, a bottom surface 18, a thickness 20 extending from the top surface 16 to the bottom surface 18, a front side 22, a rear side 24, a width 26 extending from the front side 22 to the rear side 24, a left side 28, a right side 30, a length 32 extending from the left side 28 to the right side 30, and at least one leg 34 extending from the bottom surface 18;

a middle panel 38 pivotably attached to the left panel 14 along a left pivot axis 40, the left pivot axis 40 generally perpendicular to the left panel length 32 and generally parallel to the left panel width 26, the middle panel 38 comprising a bottom surface 44, a top surface 42, a thickness 46 extending from the top surface 42 to the bottom surface 44, a front side 48, a rear side 50, a width 52 extending from the front side 48 to the rear side 50, a left side 54, a right side 56, and a length 58 extending from the left side 54 to the right side 56; and a right panel 60 pivotably attached to the middle panel 38 along a right pivot axis 62, the right pivot axis 62 generally perpendicular to the middle panel length 58 and generally parallel to the middle panel width 52, the right panel 60 comprising a top surface 64, a bottom surface 66, a thickness 68 extending from the top surface 64 to the bottom surface 66, a front side 70, a rear side 72, a width 74 extending from the front side 70 to the rear side 72, a left side 76, a right side 78, a length 80 extending from the left side 76 to the right side 78, and at least one leg 82 extending from the bottom surface 66.

The portable changing table 10 has an extended position in which the middle panel 38 extends along the right side 30 of the left panel 14 and along the left side 76 of the right panel 60 and the top surface 16 of the left panel 14 is substantially co-planar with the top surface 42 of the middle panel 38 and the top surface 64 of the right panel 60, and a collapsed position in which the right panel bottom surface 66 confronts the left panel top surface 16 and the left panel bottom surface 18 confronts the middle panel bottom surface 44. Unless otherwise noted, features of the table 10 recited herein refer to the table 10 in the extended position.

Optionally, the middle panel 38, the left panel 14, and the right panel 60 are comprised of plastic. Optionally, at least one of the front 48 of the middle panel 38 and rear 50 of the middle panel 38 comprises a handle 86. Optionally, the handle 86 is configured to pivot from a storage position in which the handle 86 is substantially co-planar with the middle panel thickness 46 to an extended position in which the handle 86 is substantially perpendicular to the middle panel thickness 46. Optionally, the handle 86 is configured to pivot along a handle pivot axis 88 from the storage position to the extended position, the handle pivot axis 88 generally parallel to the middle panel length 58. Optionally, the middle panel 38 further comprises a handle recess 118 configured to store the handle 86 when the handle 86 is in the storage position. Optionally, the handle 86 is rigid and plastic.

Optionally, the portable changing table 10 is configured to move from the extended position to the collapsed position by folding the right panel 60 between about 90 degrees and about 180 degrees relative to the middle panel 38 along the right pivot axis 62 and folding the left panel 14 between about 90 degrees and about 180 degrees relative to the middle panel 38 along the left pivot axis 40.

Optionally, the handle 86 is located at the front 48 of the middle panel 38, the right panel 60 further comprises a bottom flange 90 forming the leg 82 of the right panel 60. The bottom flange 90 has a bottom flange width 92 generally parallel to the right panel width 74 and a bottom flange height 94 generally perpendicular to the right panel width 74, and the bottom flange height 94 is at least as large as the combined thickness of the middle panel and the left panel (i.e., the sum of thicknesses 20 and 46) so that the bottom flange 90 hides the middle and left panels 38 and 14 when the table 10 is in the collapsed position.

Optionally, in the extended position, the middle panel 38 extends substantially the entire width 26 of the left panel 14 and substantially the entire width 74 of the right panel 60. Optionally, in the extended position, the table 10 further comprises a left front gap 96 located between the front 22 of the right side 30 of the left panel 14 and the front 48 of the left side 54 of the middle panel 38, a left rear gap 98 located between the rear 24 of the right side 30 of the left panel 14 and the rear 50 of the left side 54 of the middle panel 38, a right front gap 100 located between the front 70 of the left side 76 of the right panel 60 and the front 48 of the right side 56 of the middle panel 38, and a right rear gap 102 located between the rear 72 of the left side 76 of the right panel 60 and the rear 50 of the right side 56 of the middle panel 38. The purpose of the gaps 98, 100, 102 and 104 is child safety, more particularly, to prevent the child's fingers from getting caught in the table 10 while the table 10 is folded and the child is located on the top surfaces 16, 42, and 64 of the left 14, middle 38, and/or right panels 60. Optionally, each of the gaps 96, 98, 100, and 102 has a length 124 of between about 1 inch to about 8 inches (more preferably between about 1.5 inches and about 8 inches) that is generally parallel to the panel lengths 32, 58, and 80 and a width 122 of between about 1 inch to about 12 inches (more preferably between about 1.5 inches and about 8 inches) that is generally parallel to the panel widths 26, 52 and 74.

Optionally, the portable changing table 10 further comprises at least one motor 104 configured to fold the left panel 14 relative to the middle panel 38 along the left pivot axis 40 and to fold the right panel 60 relative to the middle panel 38 along the right pivot axis 62 and at least one power source 105 (e.g., a battery) configured to power the at least one motor 104. Optionally, the portable changing table 10 comprises two motors 104, the first motor 104 located adjacent the intersection of the right side 30 of the left panel bottom surface 18 and the left side 54 of the middle panel bottom surface 44 and the second motor 104 located adjacent to the intersection of the right side 56 of the middle panel bottom surface 44 and the left side 76 of the right panel bottom surface 66. Optionally, moving the handle 86 from the storage position to the extended position is configured to actuate the at least one motor 104 and moving the handle 86 from the extended position to the storage position is configured to stop the motor 104 (i.e., the handle 86 acts as a control). In other embodiments, the table 10 use a spring or elastic mechanism (instead of a motor) that is optionally actuated by the handle 86 to move the table 10 from the collapsed position to the extended position. Whatever mechanism is used to move the table 10 from the collapsed position to the extended position, the power of the mechanism should be selected with child safety in mind—i.e., not too much torque to create a hazard for a child's fingers to be caught in the table 10 when the panels 14, 38, and 60 fold or unfold.

Optionally, the left panel right side 30 comprises a left panel flange 106 extending towards the middle panel 38, wherein the middle panel left side 54 comprises a middle panel left flange 108 extending towards the left panel 14, wherein the left panel flange 106 is attached to the middle panel left flange 108 along the left pivot axis 40 to create a left hinge, wherein the right panel left side 76 comprises a right panel flange 112 extending towards the middle panel 38, wherein the middle panel right side 56 comprises a middle panel right flange 110 extending towards the right panel 60, and further wherein the right panel flange 112 is attached to the middle panel right flange 110 along the right pivot axis 62 to create a right hinge.

Optionally, the length 32 of the left panel 14 is substantially equal to the length 58 of the middle panel 38 and the length 80 of the right panel 60.

Optionally, the middle panel 38 may also include legs 116 extending from the bottom surface 44 of the middle panel 38. Optionally, the legs 34, 82 and 116 each have a height 36, 84 and 120 generally parallel to the thicknesses 20, 46 and 68 of the left 14, middle 38 and right panels 60, and further wherein the height 36, 84 and 120 of each leg 34, 82 and 116 is from about 3 inches to about 3 feet. Optionally, the legs 34, 82 and 116 are approximately the same height. Optionally, the left legs 34 are a single piece connected by a bar 114, as seen in FIGS. 1, 3, 4, and 8. Optionally, the left legs 34 are configured to pivot from a storage position in which the legs 34 are substantially co-planar relative to the bottom surface 18 of the left panel 14 to an extended position in which the legs 34 are substantially perpendicular relative to the bottom surface 18 of the left panel 14.

Optionally, the portable changing table 10 has a length 12 extending from the left panel left side 28 to the right panel right side 78, and the length 12 of the portable changing table 10 is from about 3 feet to about 8 feet.

Optionally, the top surface 16 of the left panel right side 30 confronts the top surface 42 of the middle panel left side 54 in the extended position, the confrontation of the top surface 16 of the left panel right side 30 and the top surface 16 of the middle panel left side 54 in the extended position is configured to prevent the portable changing table 10 from moving from the extended position to an over-extended position in which the top surface 16 of the left panel 14 moves towards the top surface 42 of the middle panel 38, the top surface 64 of the right panel left side 76 confronts the top surface 42 of the middle panel right side 56 in the extended position, and the confrontation of the top surface 64 of the right panel left side 76 and the top surface 42 of the middle panel right side 56 in the extended position is configured to prevent the portable changing table 10 from moving from the extended position to an over-extended position in which the top surface 64 of the right panel 60 moves towards the top surface 42 of the middle panel 38. See FIG. 6 (rotational arrows).

Optionally, the left 14, middle 38 and right panels 60 are generally rectangular in shape.

Optionally, the portable changing table 10 is used in a method that includes:

a) providing the portable changing table 10 wherein the portable changing table 10 is in the extended position; and b) placing a child on the top surfaces 16, 42, and 64 of at least one of the left panel 14, the middle panel 38 and the right panel 60.

Optionally, the child is laid across the left 14, middle 38 and right panels 60 so that the longitudinal axis of the child is generally parallel to the length 12 of the table 10.

Figure 8:
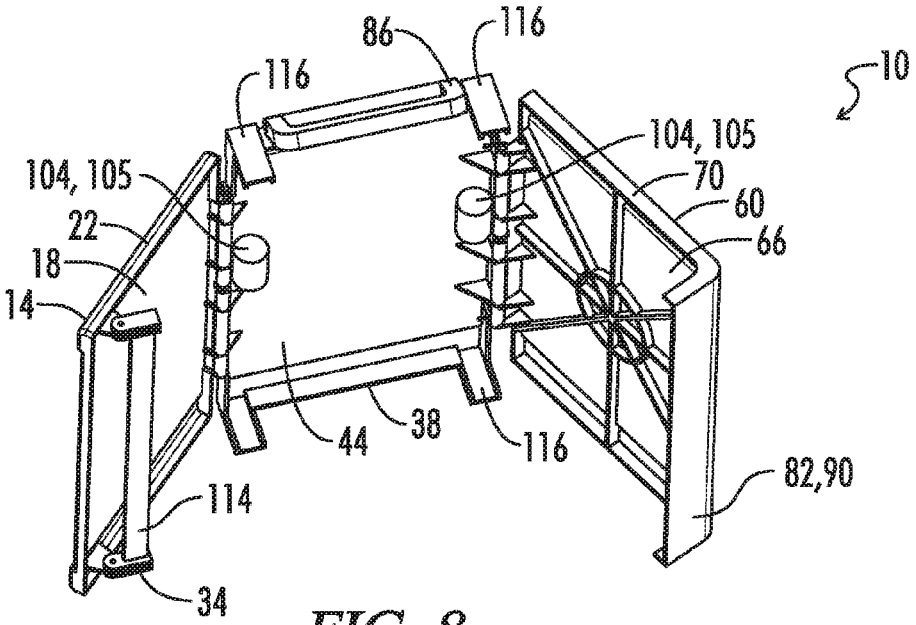
FIG. 8 illustrates a bottom, perspective view of the portable folding table of FIG. 1.
Figure 9:
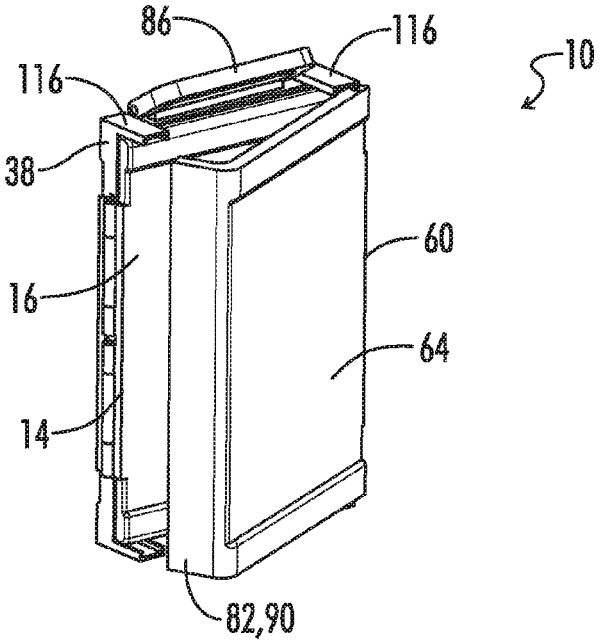
FIG. 9 illustrates a bottom, perspective view of the portable folding table of FIG. 1.
Figure 10:
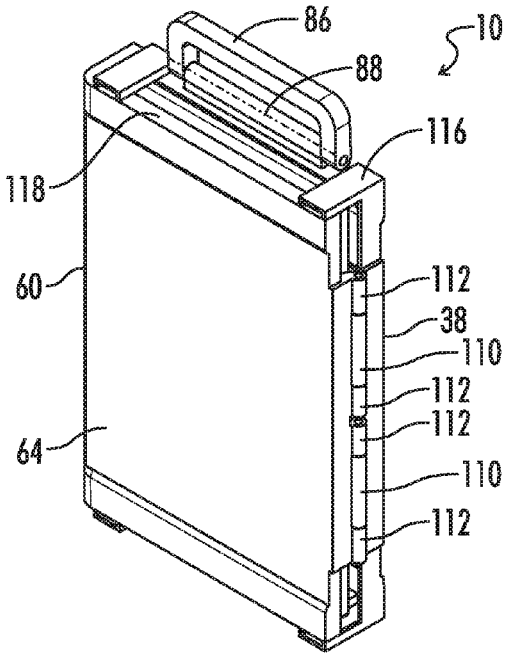
FIG. 10 illustrates a bottom, perspective view of the portable folding table of FIG. 1.
Figure 11:
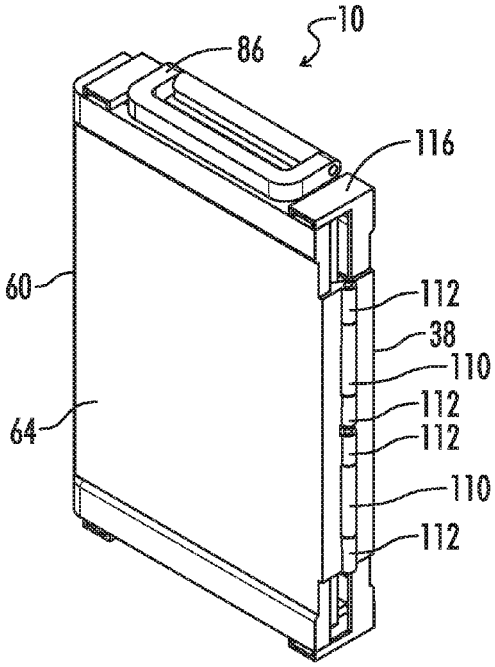
FIG. 11 illustrates a bottom, perspective view of the portable folding table of FIG. 1.
Figure 12:
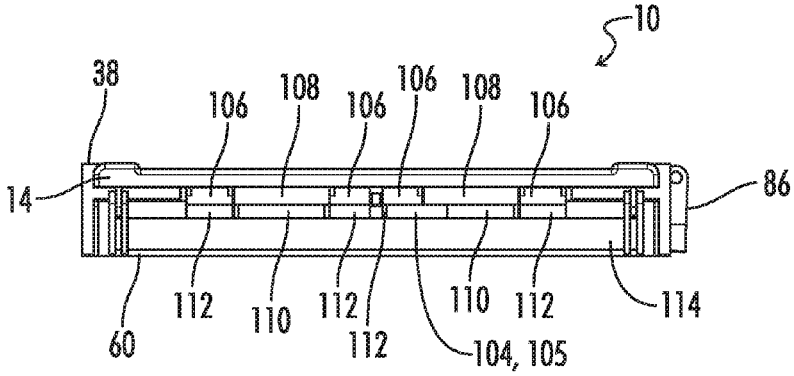
FIG. 12 illustrates a side, elevation view of the portable changing table of FIG. 1 in the collapsed position.
Figure 13:
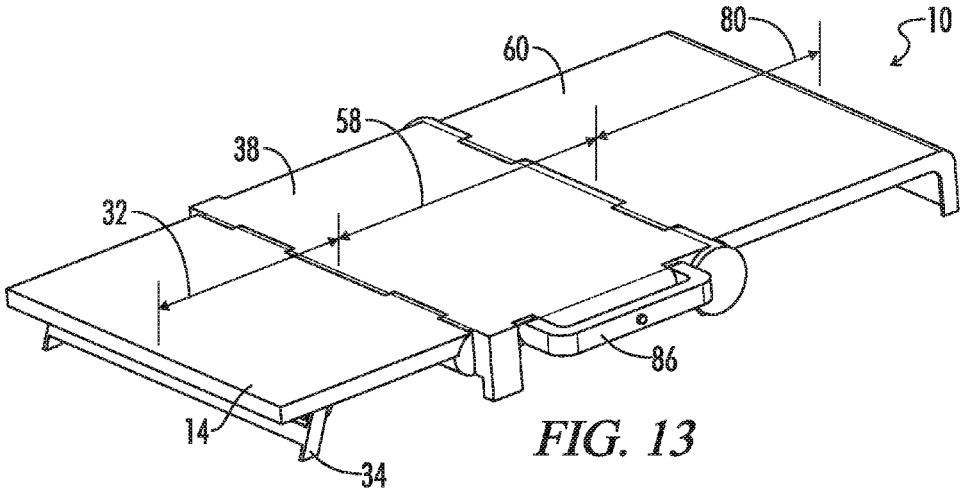
FIG. 13 illustrates a front, perspective view of a portable folding table of another embodiment of the present invention.
Figure 14:
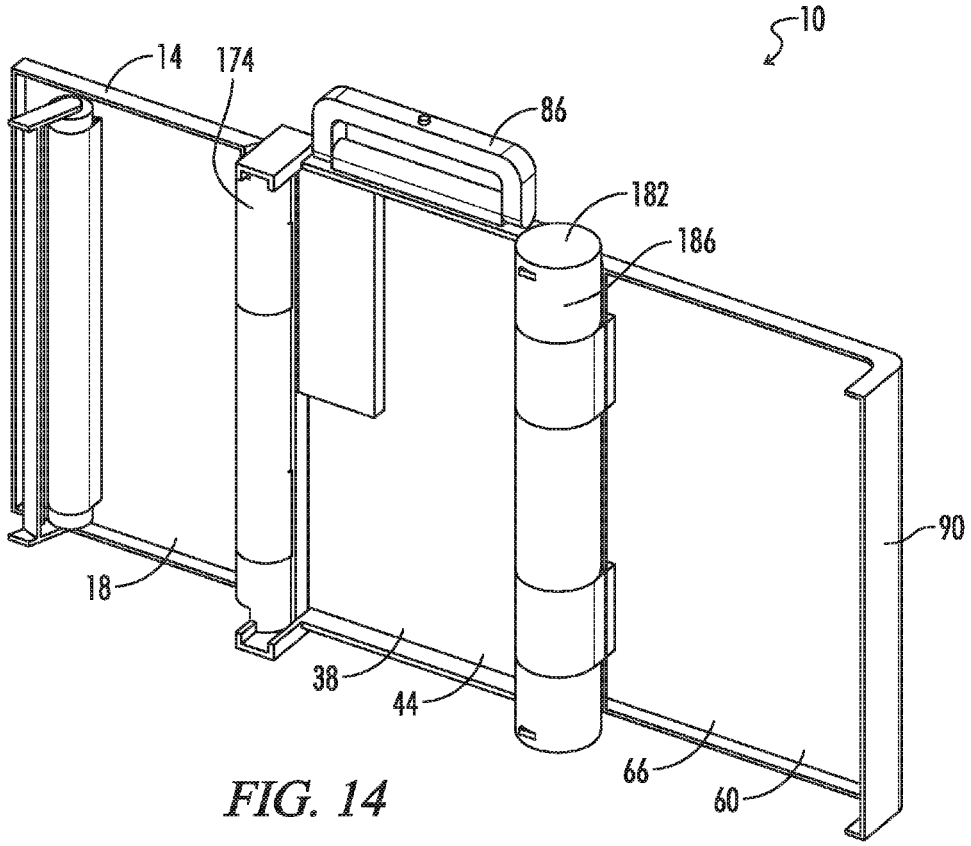
FIG. 14 illustrates a bottom, perspective view of the portable folding table of FIG. 13.
Figure 15:
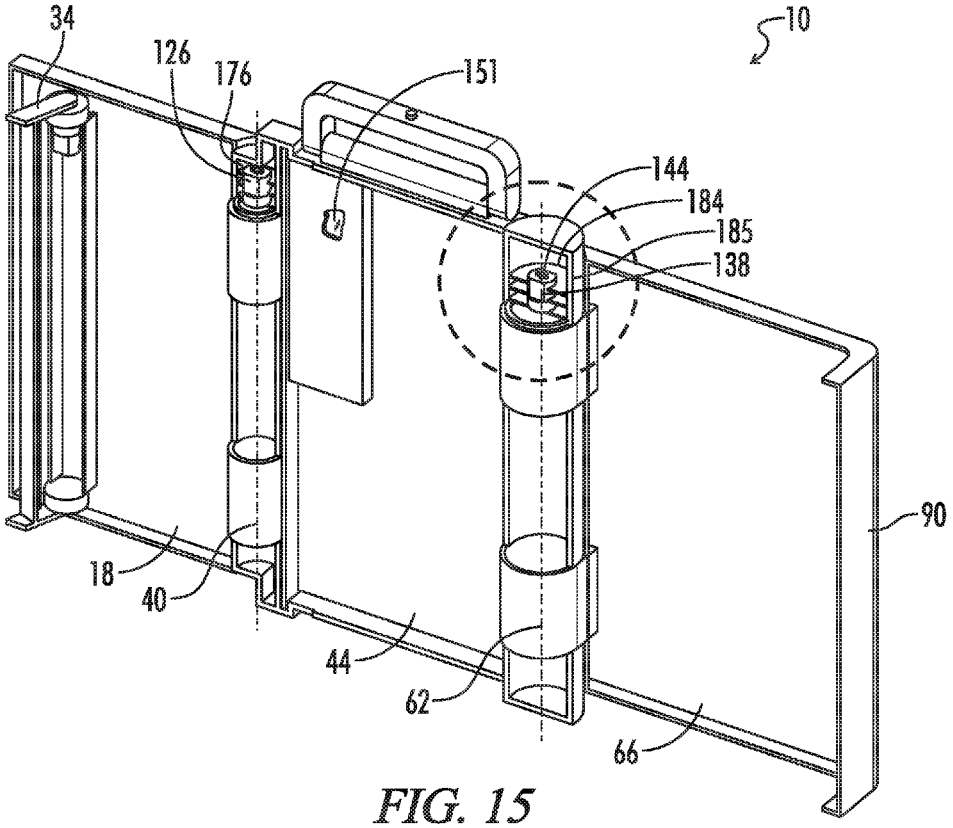
FIG. 15 illustrates a bottom, perspective view of the portable folding table of FIG. 13, in FIG. 15, the left and right housing caps are removed to show the left and right motors.

Optionally, as best seen in the sequential folding sequence illustrated in FIGS. 8-10 the portable changing table 10 is used in a method that includes:

a) providing the portable changing table 10 wherein the portable changing table 10 is in the extended position, wherein the handle 86 is located at the front 48 of the middle panel 38, wherein the right panel 60 further comprises a bottom flange 90 forming the leg 82 of the right panel 60, wherein the bottom flange 90 has a bottom flange width 92 generally parallel to the left panel width 26 and a bottom flange height 94 generally perpendicular to the bottom flange width 92, and further wherein the bottom flange height 94 is greater than or equal to the combined thickness of the middle panel 38 and the left panel 14;

b) folding the left panel 14 between about 90 and about 180 degrees relative to the middle panel 38 along the left pivot axis 40; and c) after step b, folding the right panel 60 between about 90 and about 180 degrees relative to the middle panel 38 along the right pivot axis 62.

The handle 86 is preferably located approximately at the length-wise center of the middle panel 38. The purpose behind the centrally-located handle 86 is that the table 10 can be placed generally upright, as shown in FIGS. 8-10, and easily folded and unfolded while holding the centrally-located handle 86. The inventors developed an alternate embodiment in which the handle 86 was on the right side 78 of the right panel 60 and the user held the table 10 vertically by this alternate handle 86 (with the right panel 60 above the middle panel 38 and the middle panel 38 above the left panel 14). In this alternate embodiment, the motors 104 were required to fight gravity when moving from the extended position to the collapsed position (i.e., the motors 104 were required to move the left panel 14 under the middle panel 38 and then move the left and middle panels 14 and 38 under the right panel 60), which required stronger motors 104. In the present case, the rear sides 24, 50, 72 of the left, middle and right panels 14, 38 and 60 are co-planar while folding (as shown in FIGS. 8-10) and can be supported by the ground while folding, eliminating the need to fight gravity. In addition, the present embodiment requires folding only one panel at a time (i.e., the left panel 14 is rotated relative to the middle panel 38 and then the right panel 60 is rotated relative to the middle panel 38), which requires less motor strength than the alternate embodiment, which moved two panels (the left and middle panels 14 and 38) under the right panel 60. It is desirable to use weaker motors 108, both due to cost and the safety hazards that accompany using a high torque motor to fold the table 10. Optionally, the motor 108 is a stepper motor.

Optionally, the left, middle and/or right panel bottom surfaces 18, 44 and 66 includes a lock (such as a solenoid pin, pull pin or motor driven lock) configured to releasably lock the table 10 in the extended position (i.e., to restrict rotation of the left panel 14 relative to the middle panel 38 and to restrict rotation of the right panel 60 relative to the middle panel 38), although such a lock is unnecessary when the legs 34, 82 and 116 are on a flat surface. Optionally, the lock is controlled by movement of the handle 86. Optionally, the left legs 34 include a lock configured to releasably lock the left legs 34 in the extended position.

The Embodiments of FIGS. 13-22

FIGS. 13-21 illustrate a motorized embodiment of the portable changing table 10 described above and illustrated in FIGS. 1-12. The portable changing table 10 of FIGS. 13-21 includes the left, middle and right panels, 14, 38, and 60 as described above. In addition, the previously described first and second motors 104 are illustrated in FIGS. 13-21 as a left motor 126 and a right motor 138, as described in detail below.

More particularly, the portable changing table 10 may comprise an electric left motor 126 comprising a left motor base 128 located below the middle panel top surface 42 and attached to the left side 54 of the middle panel 38 and a rotatable left motor shaft 130 extending from the left motor base 128. The left motor shaft 130 comprises a proximal segment 132, a distal segment 134 attached to the right side 30 of the left panel 14 and a left motor shaft longitudinal axis 136 (i.e., the length of the left motor shaft 130). The left motor shaft longitudinal axis 136 forms a part of the left pivot axis 40, and the left motor shaft 130 is configured to rotate about the left motor shaft longitudinal axis 136 while the left motor base 128 remains fixed to the middle panel 38. The portable changing table 10 also includes an electric right motor 138 comprising a right motor base 140 located below the middle panel top surface 42 and attached to the right side 56 of the middle panel 38 and a rotatable right motor shaft 142 extending from the right motor base 140. The right motor shaft 142 comprises a proximal segment 144, a distal segment 146 attached to the left side 76 of the right panel 60 and a right motor shaft longitudinal axis 148 (i.e., the length of the right motor shaft 142). The right motor shaft longitudinal axis 148 is generally parallel to the middle panel width 52 and forms a part of the right pivot axis 62, the right motor shaft 142 is configured to rotate about the right motor shaft longitudinal axis 148 while the right motor base 140 remains fixed to the middle panel 38.

Figure 17:
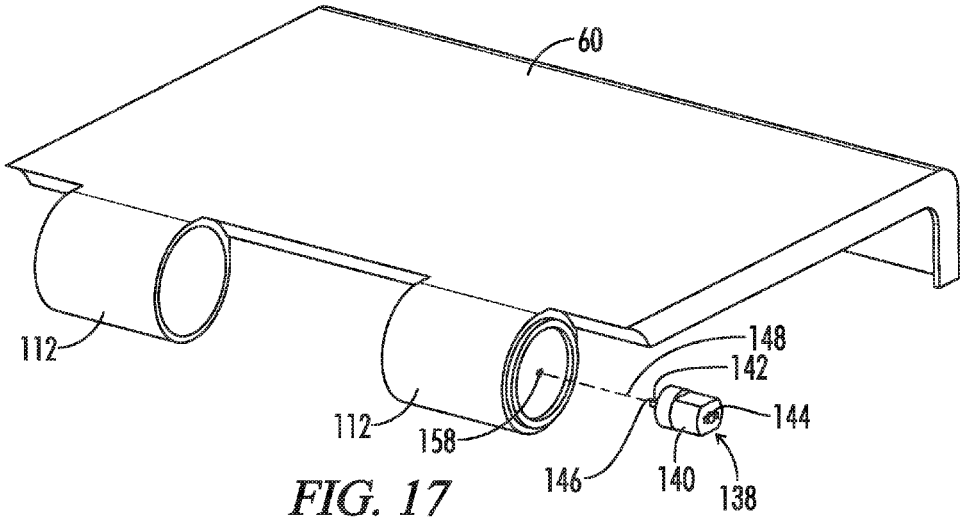
FIG. 17 illustrates left side, exploded, perspective view of the right panel of the portable changing table of FIG. 13.
Figure 18:
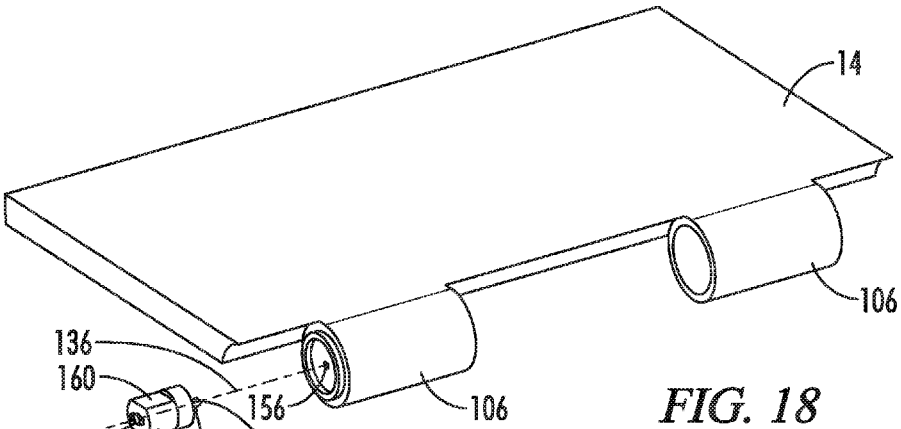
FIG. 18 illustrates a right side, exploded, perspective view of the left panel of the portable changing table of FIG. 13.
Figure 19:
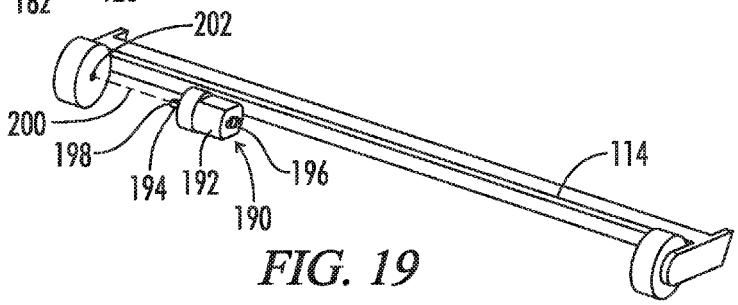
FIG. 19 illustrates a side, exploded perspective view of the left leg of the portable changing table of FIG. 13.
Figure 20:
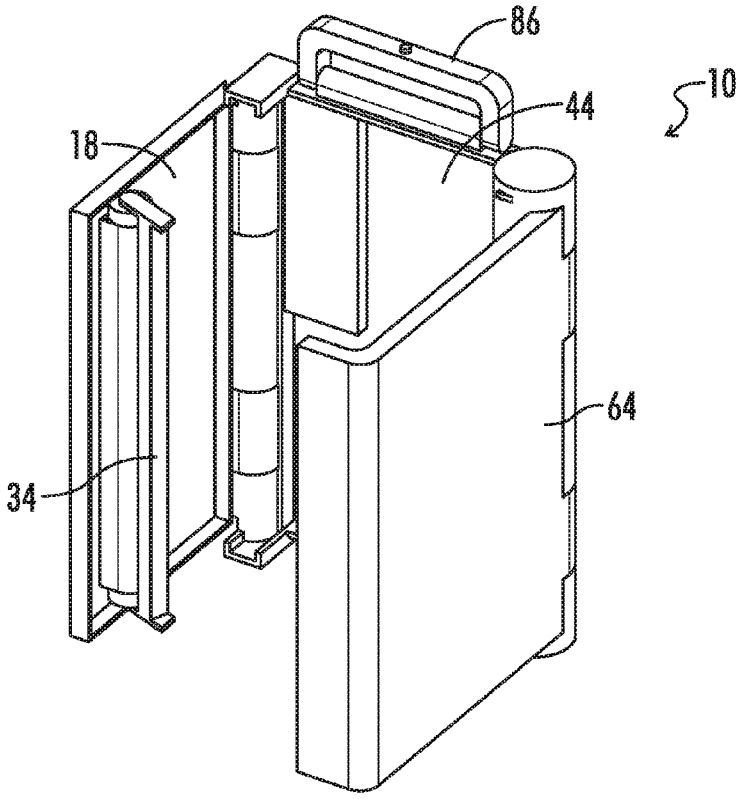
FIG. 20 illustrates a bottom, perspective view of the portable folding table of FIG. 13.
Figure 21:
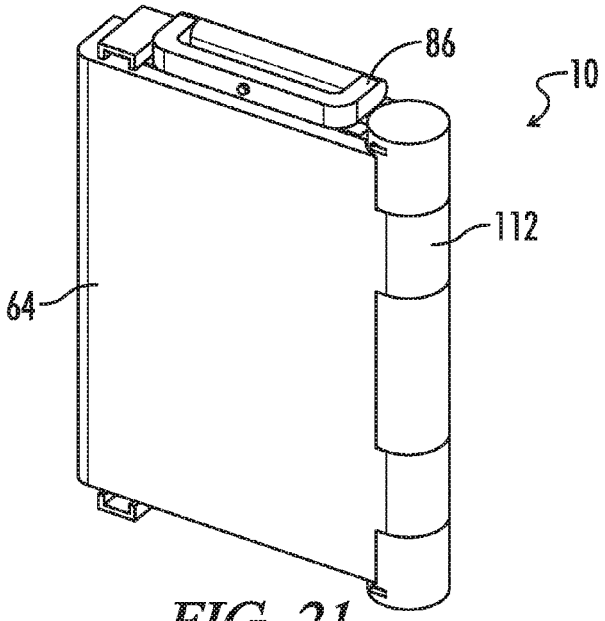
FIG. 21 illustrates a bottom, perspective view of the portable folding table of FIG. 13.

Rotation of the left motor shaft 130 about the left motor shaft longitudinal axis 136 while the left motor base 128 remains fixed to the middle panel 38 and rotation of the right motor shaft 142 about the right motor shaft longitudinal axis 148 while the right motor base 142 remains fixed to the middle panel 38 causes the left panel 14 and right panel 60 to move relative to the middle panel 38 and the portable changing table 10 to move from the collapsed position to the extended position. It will be appreciated that typically the left motor shaft longitudinal axis 136 forms part of the left pivot axis 40 and the right motor shaft longitudinal axis 148 forms part of the right pivot axis 62, given that the left motor shaft 130 and right motor shaft 142 are generally short, as shown in FIGS. 17-19. In other words, the portable changing table 10 is configured to move from the extended position to the collapsed position by using the right motor 138 to fold the right panel 60 between about 90 degrees and about 180 degrees relative to the middle panel 38 along the right pivot axis 60 and by using the left motor 126 to fold the left panel between about 90 degrees and about 180 degrees relative to the middle panel 38 along the left pivot axis 40. Generally, the left motor shaft 130 and right motor shafts 142 will rotate in opposite directions, e.g., while moving from the collapsed position to the extended position, one motor shaft 130 or 142 will rotate clockwise and the other motor shaft 130 or 142 will rotate counterclockwise.

The motors 126 and 138 are bi-directional, meaning that they can rotate in two directions so to allow the portable changing table 10 to move from the collapsed position to the extended position and from the extended position to the collapsed position.

Optionally, the left motor base 128 is attached to the middle panel left flange 108, the left motor shaft distal segment 134 is attached to the left panel flange 106, the right motor base 140 is attached to the middle panel right flange 110 and the right motor shaft distal segment 146 is attached to the right panel flange 112.

Figure 16:
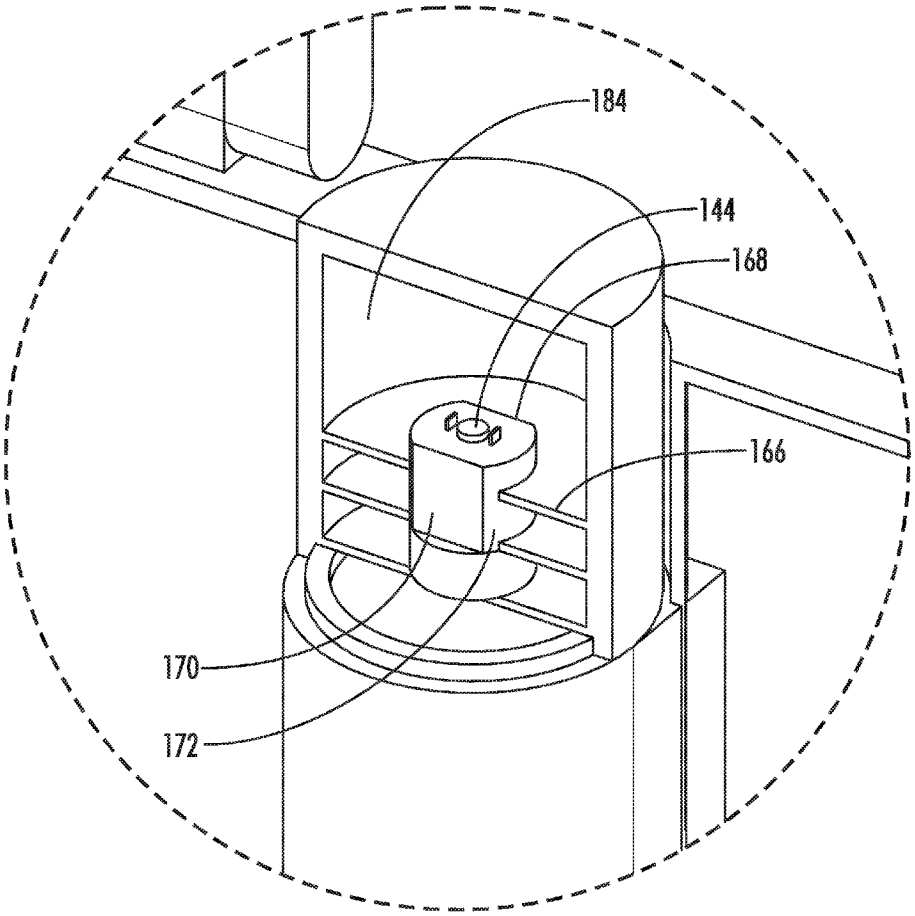
FIG. 16 illustrates a bottom, close-up, perspective view of the right motor housing of the portable folding table of FIG. 13.

Optionally, the right motor base 140 comprises a bottom surface 170 that may be generally flat and a top surface 168 comprising right motor teeth 172, and further wherein the middle panel right side 56 comprises middle panel right side teeth 166 engaging the right motor teeth 168, as seen in FIG. 16. Though not shown the left motor base 128 may similarly comprise a bottom surface that may be generally flat and a top surface comprising left motor teeth, and the middle panel left side 54 comprises middle panel left side teeth engaging the left motor teeth.

The portable changing table 10 may further comprise a right motor housing 182 (i.e., housing for the right motor 138) comprising a right housing removable cap 186 and a right housing base 185 fixed to the middle panel 38, the right housing removable cap 186 configured to removably engage the right housing base 185, and the right motor housing 182 further comprises a right housing interior 184 comprising the right motor base 140 and a right motor battery (not shown) (i.e., one or more batteries), and the portable changing table may further comprise a left motor housing 174 (i.e., a housing for the left motor 126) comprising a left housing removable cap (not shown) and a left housing base (not shown) fixed to the middle panel 38, the left housing removable cap configured to removably engage the left housing base, and the left motor housing 174 further comprising a left housing interior 176 comprising the left motor base 128 and a left motor battery (not shown) (i.e, one or more batteries). For example, the removable caps 186 and housing bases 185 may be each comprised of plastic and may be attached via a snap fit.

Optionally, at least one the left and right panel legs 34 and 82 (preferably the left leg 34) is movable and motorized, and the portable changing table 10 further comprises an electric leg motor 190 comprising a leg motor base 192 attached to a panel 14 or 60 (preferably left panel 14 as shown) and a rotatable leg motor shaft 194 extending from the leg motor base 192, the leg motor shaft 194 comprising a proximal segment 196, a distal segment 198 attached to the moveable leg 34 or 82 and a leg motor shaft longitudinal axis 200 generally parallel to the width 26 or 74 of the panel 14 or 60 to which the leg motor base 192 is attached (e.g., the left panel 14 as shown in FIGS. 13-21). The leg motor shaft 194 is configured to rotate about the leg motor shaft longitudinal axis 200 while the leg motor base 192 remains fixed to the panel 14 or 60 and further wherein rotation of the leg motor shaft 194 about the leg motor shaft longitudinal axis 200 while the leg motor base 192 remains fixed to the panel 14 or 60 is configured to move the moveable leg 34 or 82 from a storage position in which the moveable leg 34 or 82 is substantially co-planar with the bottom surface 18 or 66 of the panel 14 or 60 to which the leg 34 or 82 is attached to an extended position in which the moveable leg 34 or 82 is between about 30 and 150 degrees relative to the bottom surface 18 or 66 of the panel 14 or 60 to which the leg 34 or 82 is attached.

Figure 22:
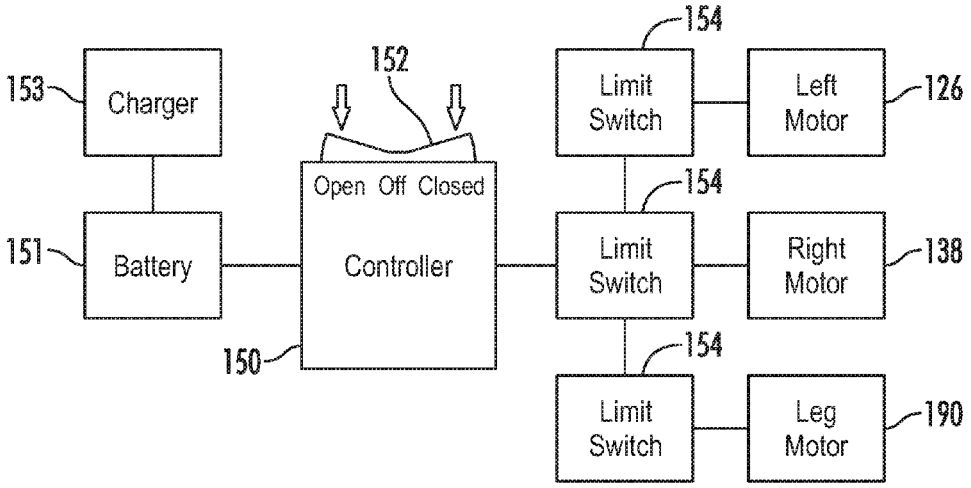
FIG. 22 is a schematic showing a controller that may be used to control operation of the portable changing table.

The portable changing table 10 may further comprise a controller 150 controlling movement of the left motor shaft 130 about the left motor shaft longitudinal axis 136 and movement of the right motor shaft 142 about the right motor shaft longitudinal axis 148. In one particular embodiment, shown in FIG. 22, the left motor 126, the right motor 138 and the leg motor 190 are controlled by the controller 150 and powered by a re-chargeable battery 151 that may be re-charged by a charger 153. More particularly, as shown in FIG. 22, the controller 150 comprises a rocker switch 152 that has three positions: 1) an open position wherein depressing the rocker switch 152 on the left side causes the left motor 126 and the right motor 138 (more particularly, the left and right motor shafts 130 and 142) to move the left and right panels 14 and 60 from the collapsed position to the extended position (as previously described) and the leg motor 190 (more particularly the leg motor shaft 194) to move the leg 34 from the storage position to the extended position; 2) an off position in which the user is not depressing the rocker switch 152 and the controller 150 prevents the flow of electricity to the left motor 126, the right motor 138 and the leg motor 190 (and consequently prevents the motors 126, 138 and 190 from moving the left and right panels 14 and 38 and the leg 34); and 3) a closed position wherein depressing the rocker switch 152 on the right side causes the left motor 126 and the right motor 138 (more particularly, the left and right motor shafts 130 and 142) to move the left and right panels 14 and 60 from the extended position to the collapsed position and the leg motor 190 (more particularly the leg motor shaft 194) to move the leg 34 from the extended position to the storage position. In addition, once the left and right panels 14 and 60 and the leg 34 reach the extended position and the collapsed position, a limit switch 154 may be employed to prevent over-rotation of the legs 34 and left and right panels 14 and 60.

Optionally, the left motor shaft distal segment 134 is a non-circular shape and is located in a non-circular recess 156 in the middle panel left side 54 (more particularly, the middle panel left flange 108) and the right motor shaft distal segment 146 is a non-circular shape and is located in a non-circular recess 158 in the middle panel right side 56 (more particularly, in the middle panel right flange 110). For example, the left and right motors 126 and 138 may each be a D-Key motor, with shafts 130 and 142 shaped generally in the shape of a D", in which case the recesses 156 and 158 are similarly shaped in the shape of a "D". The left and right motors 126 and 138 and the leg motor 190 each may be, for example, a 60 RPM planetary gear motor, with a plastic planetary gear reducer section and voltage may be between about three to about six volts. Like the recesses 156 and 158 described for the left and right motors 126 and 138, the leg motor shaft distal segment 198 may be located in a non-circular recess 202 of the leg 14 or 60, as shown in FIG. 19.

Optionally, the portable changing table 10 may be used in a method that includes: a) providing the portable changing table 10, wherein the front 48 of the middle panel 38 comprises a handle 86 and the rear 50 of the middle panel 38 is resting on a surface (e.g., on the ground or on another table); and b) folding the left panel 14 between about 90 and about 180 degrees relative to the middle panel 38 along the left pivot axis 40 using the left motor 126 and folding the right panel 60 between about 90 and about 180 degrees relative to the middle panel 38 along the right pivot axis 62 using the right motor 138. The user preferably holds the handle 86 while the portable changing table 10 folds. In other words, to move the portable changing table from the extended position to the collapsed position, the user holds the portable changing table 10 by the handle 86 and the left panel front side 22, the middle panel front side 48, and the right panel front side 70 are generally co-planar to each other and parallel to (and above) the left panel rear side 30, the middle panel rear side 50 and the right panel rear side 72, which are also generally co-planar to each other.

Figure 23:
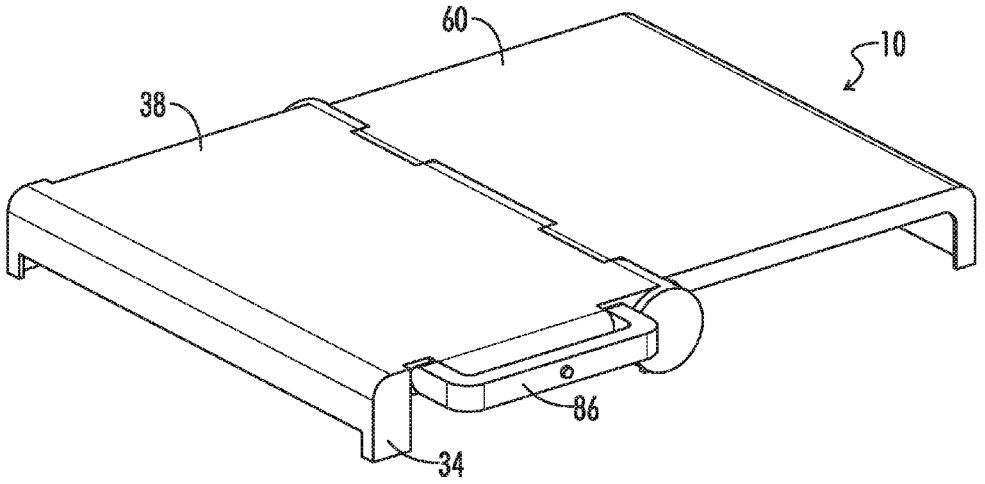
FIG. 23 illustrates a front, perspective view of alternate embodiment of a portable changing table with only two panels.

FIG. 23 illustrates yet another alternate embodiment of a portable changing table 10. In FIG. 23, the portable changing table 10 has only two panels, the middle panel 38 and the right panel 60 (i.e., the left panel 14 has been eliminated), and the portable changing table includes the right motor 138 but not the left motor 126. In FIG. 23, the right panel 60 folds relative to the middle panel 38 in a similar way as previously described for the middle panel 38 and right panels 60 (as illustrated for FIGS. 1-22). It will be understood that when it is said that the portable changing table 10 comprises two or three panels, the portable changing table 10 may have more than two or three panels, respectively, given the nature of the definition "comprising."

Having now described the invention in accordance with the requirements of the patent statutes, those skilled in the art will understand how to make changes and modifications to the disclosed embodiments to meet their specific requirements or conditions. Changes and modifications may be made without departing from the scope and spirit of the invention. In addition, the steps of any method described herein may be performed in any suitable order and steps may be performed simultaneously if needed.

Terms of degree such as "generally", "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

What is claimed is:

1. A portable changing table comprising:

a left panel comprising a top surface, a bottom surface, a thickness extending from the top surface to the bottom surface, a front side, a rear side, a width extending from the front side to the rear side, a left side, a right side, a length extending from the left side to the right side, and at least one leg extending from the bottom surface;

a middle panel pivotably attached to the left panel along a left pivot axis, the left pivot axis generally perpendicular to the left panel length and generally parallel to the left panel width, the middle panel comprising a top surface, a bottom surface, a thickness extending from the top surface to the bottom surface, a front side, a rear side, a width extending from the front side to the rear side, a left side, a right side, and a length extending from the left side to the right side;

a right panel pivotably attached to the middle panel along a right pivot axis, the right pivot axis generally perpendicular to the middle panel length and generally parallel to the middle panel width, the right panel comprising a top surface, a bottom surface, a thickness extending from the top surface to the bottom surface, a front side, a rear side, a width extending from the front side to the rear side, a left side, a right side, a length extending from the left side to the right side, and at least one leg extending from the bottom surface, a left motor comprising a left motor base attached to the left side of the middle panel and a rotatable left motor shaft extending from the left motor base, the left motor shaft comprising a proximal segment, a distal segment attached to the right side of the left panel and a left motor shaft longitudinal axis generally parallel to the middle panel width and forming a part of the left pivot axis, the left motor shaft configured to rotate about the left motor shaft longitudinal axis while the left motor base remains fixed to the middle panel, a right motor comprising a right motor base attached to the right side of the middle panel and a rotatable right motor shaft extending from the right motor base, the right motor shaft comprising a proximal segment, a distal segment attached to the left side of the right panel and a right motor shaft longitudinal axis generally parallel to the middle panel width and forming a part of the right pivot axis, the right motor shaft configured to rotate about the right motor shaft longitudinal axis while the right motor base remains fixed to the middle panel, wherein the portable changing table has an extended position in which the middle panel extends along the right side of the left panel and along the left side of the right panel and the top surface of the left panel is substantially co-planar with the top surface of the middle panel and the top surface of the right panel, wherein the portable changing table has a collapsed position in which the right panel bottom surface confronts the left panel top surface and the left panel bottom surface confronts the middle panel bottom surface, and further wherein rotation of the left motor shaft about the left motor shaft longitudinal axis while the left motor base remains fixed to the middle panel and rotation of the right motor shaft about the right motor shaft longitudinal axis while the right motor base remains fixed to the middle panel cause the left and right panels to move relative to the middle panel and the portable changing table to move from the extended position to the collapsed position.

2. The portable changing table of claim 1, wherein at least one of the front of the middle panel and the rear of the middle panel comprises a rigid plastic handle.

3. The portable changing table of claim 2, wherein the handle is configured to pivot from a storage position in which the handle is substantially co-planar with the middle panel thickness to an extended position in which the handle is substantially perpendicular to the middle panel thickness.

4. The portable changing table of claim 2, wherein the handle is located at the front of the middle panel, wherein the right panel further comprises a bottom flange forming the at least one leg of the right panel, wherein the bottom flange has a bottom flange width generally parallel to the right panel width and a bottom flange height generally perpendicular to the right panel width, and further wherein the bottom flange height is at least as large as the combined thickness of the middle panel and the left panel.

5. The portable changing table of claim 1, wherein the portable changing table further comprises at least one power source configured to power the left motor and the right motor by electricity and a rocker switch controlling the flow of the electricity from the at least one power source to the left motor and the right motor.

6. The portable changing table of claim 5, wherein depressing the rocker switch on a first side causes the left motor and the right motor to move the left and right panels from the collapsed position to the extended position, and depressing the rocker switch on a side opposite to the first side causes the left motor and the right motor to move the left and right panels from the extended position to the collapsed position.

7. The portable changing table of claim 1, wherein the portable changing table is configured to move from the extended position to the collapsed position by using the right motor to fold the right panel between about 90 degrees and about 180 degrees relative to the middle panel along the right pivot axis and by using the left motor to fold the left panel between about 90 degrees and about 180 degrees relative to the middle panel along the left pivot axis.

8. The portable changing table of claim 1, wherein the left motor shaft distal segment is a non-circular shape and is located in a non-circular recess in the middle panel left side and further wherein the right motor shaft distal segment is a non-circular shape and is located in a non-circular recess in the middle panel right side.

9. The portable changing table of claim 1 wherein the at least one leg attached to the left panel is moveable and further wherein the portable changing table further comprises a leg motor comprising a leg motor base attached to the left panel and a rotatable leg motor shaft extending from the leg motor base, the leg motor shaft comprising a proximal segment, a distal segment attached to the at least one leg and a leg motor shaft longitudinal axis generally parallel to the width of the left panel, the leg motor shaft configured to rotate about the leg motor shaft longitudinal axis while the leg motor base remains fixed to the left panel and further wherein rotation of the leg motor shaft about the leg motor shaft longitudinal axis while the leg motor base remains fixed to the left panel is configured to move the at least one leg from a storage position in which the at least one leg is substantially co-planar with the bottom surface of the left panel to an extended position in which the moveable leg is between about 30 degrees and about 150 degrees relative to the bottom surface of the left panel.

10. The portable changing table of claim 1, wherein the left panel right side comprises a left panel flange extending towards the middle panel, wherein the middle panel left side comprises a middle panel left flange extending towards the left panel, wherein the left motor base is attached to the middle panel left flange, wherein the left motor shaft distal segment is attached to the left panel flange, wherein the right panel left side comprises a right panel flange extending towards the middle panel, wherein the middle panel right side comprises a middle panel right flange extending towards the right panel, wherein the right motor base is attached to the middle panel right flange, and further wherein the right motor shaft distal segment is attached to the right panel flange.

11. The portable changing table of claim 1, wherein the length of the left panel is substantially equal to the length of the middle panel and the length of the right panel.

12. The portable changing table of claim 1, wherein the legs each have a height generally parallel to the thicknesses of the left, middle and right panels, and further wherein the height of each leg is from about 3 inches to about 3 feet.

13. The portable changing table of claim 1 wherein the portable changing table has a length extending from the left panel left side to the right panel right side, and further wherein the length of the portable changing table is from about 3 feet to about 8 feet.

14. The portable changing table of claim 1, wherein the top surface of the left panel right side confronts the top surface of the middle panel left side in the extended position, wherein the confrontation of the top surface of the left panel right side and the top surface of the middle panel left side in the extended position is configured to prevent the portable changing table from moving from the extended position to an over-extended position in which the top surface of the left panel moves towards the top surface of the middle panel, wherein the top surface of the right panel left side confronts the top surface of the middle panel right side in the extended position, and wherein the confrontation of the top surface of the right panel left side and the top surface of the middle panel right side in the extended position is configured to prevent the portable changing table from moving from the extended position to an over-extended position in which the top surface of the right panel moves towards the top surface of the middle panel.

15. The portable table changing table of claim 1 wherein the left motor base comprises a bottom surface and a top surface comprising left motor teeth, wherein the middle panel left side comprises middle panel left side teeth engaging the left motor teeth, wherein the right motor base comprises a bottom surface and a top surface comprising right motor teeth, and further wherein the middle panel right side comprises middle panel right side teeth engaging the right motor teeth.

16. A method of using a portable changing table comprising the steps of:

a) providing the portable changing table of claim 1 wherein the portable changing table is in the extended position; and b) placing a child on the top surfaces of at least one of the left panel, the middle panel and the right panel.

17. A method of using a portable changing table comprising the steps of:

a) providing the portable changing table of claim 1 wherein the portable changing table is in the extended position, wherein the front of the middle panel comprises a handle and the rear side of the left panel, the rear side of the middle panel, and the rear side of the right panel are resting on a surface; and b) using the left motor to fold the left panel between about 90 degrees and about 180 degrees relative to the middle panel along the left pivot axis and using the right motor to fold the right panel between about 90 degrees and about 180 degrees relative to the middle panel along the right pivot axis.

18. A portable changing table comprising:

a first panel comprising a top surface, a bottom surface, a thickness extending from the top surface to the bottom surface, a front side, a rear side, a width extending from the front side to the rear side, a left side, a right side, a length extending from the left side to the right side, and at least one leg extending from the bottom surface;

a second panel pivotably attached to the first panel along a first pivot axis, the first pivot axis generally perpendicular to the first panel length and generally parallel to the first panel width, the second panel comprising a top surface, a bottom surface, a thickness extending from the top surface to the bottom surface, a front side, a rear side, a width extending from the front side to the rear side, a left side, a right side, and a length extending from the left side to the right side;

a motor comprising a motor base attached to a side of the first panel adjacent to the second panel and a rotatable motor shaft extending from the motor base, the motor shaft comprising a proximal segment, a distal segment attached to a side of the second panel and a motor shaft longitudinal axis generally parallel to the second panel width and forming part of the first pivot axis, the motor shaft configured to rotate about the motor shaft longitudinal axis while the motor base remains fixed to the first panel, wherein the portable changing table has an extended position in which the left side of the second panel extends along the right side of the first panel and the top surface of the first panel is substantially co-planar with the top surface of the second panel, wherein the portable changing table has a collapsed position in which the second panel does not extend along the right side of the first panel and in which the top surface of the first panel is not substantially co-planar with the top surface of the second panel, and further wherein the portable changing table is configured to move from the extended position to the collapsed position by rotating the motor shaft and the second panel attached to the motor shaft about the motor shaft longitudinal axis while the motor base remains fixed to the first panel.

19. A method of using a portable changing table comprising the steps of:

a) providing the portable changing table of claim 18 wherein the portable changing table is in the extended position, wherein the front of one of the first and second panels comprises a rigid handle and the rear of the first and second panels are resting on a surface; and b) folding the first panel between about 90 degrees and about 180 degrees relative to the second panel along the pivot axis.

* * * * *